United States Patent [19]

Grassi

[11] Patent Number: 4,776,090

[45] Date of Patent: Oct. 11, 1988

[54] NAIL CLIPPER CATCHER

[76] Inventor: Mario R. Grassi, 15 Highridge Rd., Monroe, N.Y. 10950

[21] Appl. No.: 107,444

[22] Filed: Oct. 13, 1987

[51] Int. Cl.[4] ..... A45D 29/02

[52] U.S. Cl. ..... 30/28; 132/73

[58] Field of Search ..... 30/28, 124, 125, 131; 132/73, 75

[56] References Cited

U.S. PATENT DOCUMENTS

| | | | |
|---|---|---|---|
| 2,837,821 | 6/1958 | David | 30/28 X |
| 2,887,773 | 5/1959 | Killen | 30/28 |
| 3,352,010 | 11/1967 | Keller | 30/28 |
| 4,130,937 | 12/1978 | Kim | 30/28 |
| 4,519,134 | 5/1985 | Bumbera | 30/28 |

FOREIGN PATENT DOCUMENTS

| | | | |
|---|---|---|---|
| 1201884 | 3/1986 | Canada | 30/28 |

*Primary Examiner*—E. R. Kazenske
*Assistant Examiner*—Michael D. Folkerts
*Attorney, Agent, or Firm*—Wolder, Gross & Yavner

[57] ABSTRACT

A nail clipper includes a removable receptacle for receiving the nails as they are clipped. The basic construction is relatively standard, except that the lower arm of the pivoting cutters defines an opening through which the clipped nails enter the receptacle. A cushion is also provided between the arms at approximately their pivot point, in order to deflect clipped nails into the receptacle, through the opening. Guidance for the pivoting arms is provided by a band, affixed to the lower arm and movable relative to the upper arm.

3 Claims, 2 Drawing Sheets

NAIL CLIPPER CATCHER

This invention relates primarily to nail clippers and more particularly to nail clippers of the type wherein a receptacle is provided for receiving the clipped nails.

The present state of the art relating to nail clippers has recognized, in a manner, the problem relating to the mess created by clipped nails. Of course, nail clippers have for many years been of a basic construction including a pair of arms pivotably connected at their rearward portion. The forward portion of the pivoting arms defines cutting end edges, and, usually, a post is affixed to the lower arm proximate its edge, upwardly extending through the upper arm. A handle member mates with the post at its upper end and has a fulcrum depending downwardly just rearwardly of the post. The rearward end of the handle member is thereby able to provide the cutting motion by being depressed at its rearward end so that the fulcrum causes the upper arm, at its forward edge, to move downwardly toward the lower arm. The pressure provided between the edges, formed as cutting blades, accomplishes the cutting of finger or toe nails.

Representative of the relatively recent recognition of the need for a solution to the mess-causing problem are the patents by Chase (U.S. Pat. No. 3,188,737) and Reinicke (U.S. Pat. No. 4,550,496). In the Reinicke patent, a teaching is made of a receptacle shaped in a manner, whereby the deposit of clipped nails in the receptacle depends to a great extent upon rearward, as well as outwardly lateral, motion of said clipped nails. In most cases, the Reinicke structure is less than satisfactory, in that the motion of clipped nails in the standard form of nail clipper is primarily rearwardly.

As to Chase, the nail receptacle depends primarily on rearward movement and propulsion of the clipped nails, the receptacle being placed between the pivoting arms. However, the removability of the receptacle for emptying is somewhat difficult with Chase.

In either event, with respect to Chase, Reinicke and like structures, the form of construction is different than that presented for the present invention, and more importantly, the present invention provides easy removability for emptying the clipped nails and more satisfactory collection in the receptacle for the clipped nails, the structure of the present invention depending more upon rearward propulsion upon cutting rather than lateral propulsion.

Accordingly, it is a primary object of the present invention to provide a nail clipper, with a receptacle for receiving the clipped nails;

A further, and more particular object of the present invention is to provide a nail clipper with a receptacle in a form of construction which depends more upon rearward motion of the clipped nails after cutting, rather than lateral motion;

A still further object of the present invention is to provide a means for directing the clipped nails to the receptacle in an efficient manner; and It is also an object of the present invention to provide an easily removable receptacle for emptying purposes, without drastically altering the standard form of nail clipper.

These and other objects of the present invention are provided in a nail clipper construction, which includes a pair of opposed and pivotably connected upper and lower jaw arms. The arms further include a midportion and terminate at their forward ends in a cutting end edge. A band encircles the arms proximate their forward edges, the band being fixedly attached to the lower arm, with the upper arm being movable relative to the band. The construction also has a handle member which is wedged under the band and has a depending fulcrum for pressing down on the upper arm, causing it to move toward the lower arm. At the midportion of the lower arm, a receptacle opening is defined, with a receptacle encircling the arms and providing a clipped nail receiving interior, mostly below the defined opening. More particularly, the receptacle is constructed to slide rearwardly from around the arms in order to be emptied. A flexible cushion member is provided between the arms, just rearwardly of the opening so that a concave face of the member faces inwardly and deflects clipped nails through the opening and into the receptacle.

Other objects, features and advantages of the present invention will become more apparent by reference to the accompanying drawings and a more detailed description referring thereto, wherein.

Figures 1, 2:
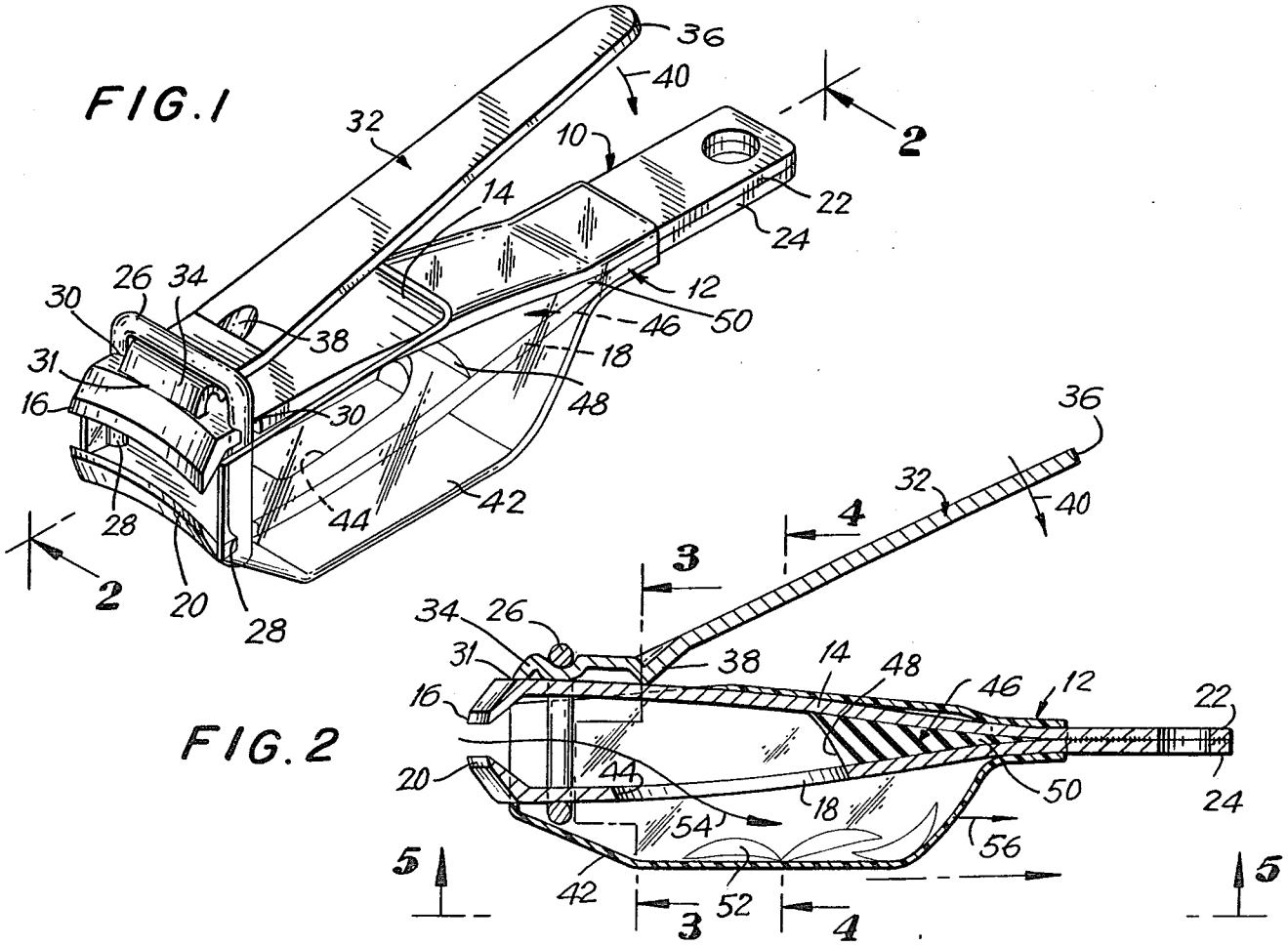
FIG. 1 is a front or forward and right side isometric view of a nail clipper according to the present invention.
FIG. 2 is a right side sectional view thereof, taken through the line 2—2 of FIG. 1.
Figure 4:
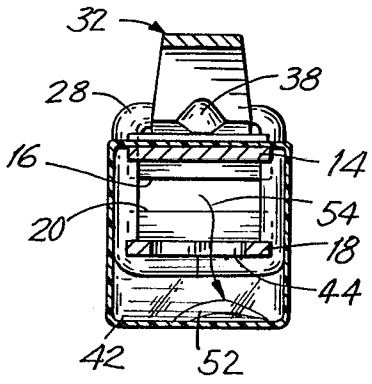
FIG. 4 is a rear sectional view of the invention shown in FIG. 2, taken through the line 4—4 thereof.
Figure 5:
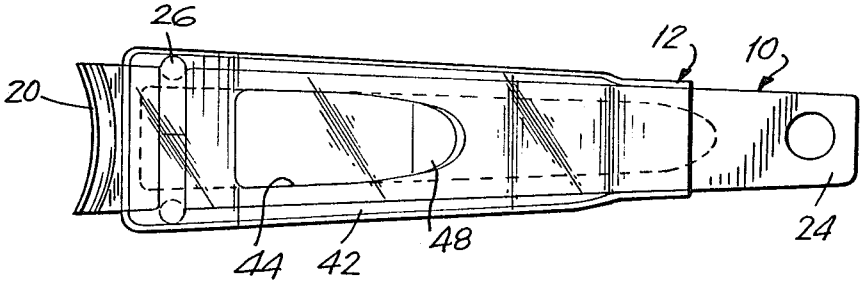
FIG. 5 is a bottom sectional view of the nail clipper of FIG. 2, taken through the line 5—5 thereof.
Figure 3:
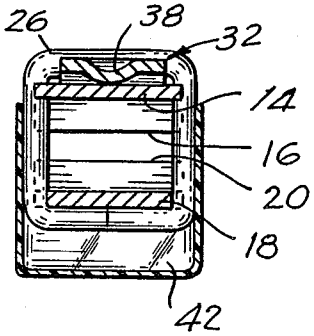
FIG. 3 is a rear sectional view of the nail clipper of FIG. 2, taken through the line 3—3 thereof.

Referring to the drawings, with more particularity, a nail clipper is shown with a pair of opposed, pivotably connected, upper and lower jaw arms, generally designated 10, 12, respectively. Arm 10 has a midportion 14 and terminates at its forward end in a cutting end edge 16.

Likewise, lower arm 12 has a midportion 18 and a forwardly located cutting end edge 20. The arms 10, 12 are pivotably connected at approximately their rearward ends 22 for the upper arm 10, and 24 for the lower arm 12.

A band 26 encircles arms 10 and 12 proximate edges 16, 20. Band 26 is fixedly attached to lower arm 12 at points 28 and upper arm 10 is movably relative to band 26 at points 30.

A handle member generally designated 32 causes the arms to provide a cutting operation at edges 16, 20, by means of its construction including a forward end 34, a rearward end 36 and a depending fulcrum 38. Forward end 34 is wedged under band 26, between the band and upper arm 14. Accordingly, the handle member 32 construction operates by downward pressure in direction 40 caused at the rear end 36, which in turn causes downward pressure by means of fulcrum 38 and attendant downward motion of the forward edge 16 of upper arm 10. Thus, cutting edge 16 is forced into cutting relationship with cutting edge 20 of lower arm 12.

A removable receptacle 42, preferably of clear plastic, but which may be of opaque or colored material, is provided to slide over and encircle midpoints 14 and 18. The mounting motion for receptacle 42 is from the rear of the nail clipper, so that the receptacle 42 is placed in a position to receive clippings of nails cut by edges 16, 20. In this regard, an opening 44 is provided in lower arm 12 and between arms 10, 12 is placed a flexible, plastic or sponge-like material in the form of a flexible cushion member generally designated 46, the forward end 48 of which is concave. The forwardly facing concave end 48 is arranged just rearwardly of opening 44, and v-shaped rear portion 50 of flexible member 46 fits conveniently between arms 10, 12.

In operation, the user presses rear end 36 of handle member 32 in a downward direction 40. This causes fulcrum 38 to press downwardly against upper arm 10, because of the fact that handle member 32, at its forward edge 31 is wedged between band 26 and upper arm 10. The downward motion of fulcrum 38 moves cutting edge 16 into cutting relationship with cutting edge 20 of lower arm 12. The nail 52 is clipped and normally propels in direction 54 through opening 44 and into receptacle 42. In order to confine the propulsion of nail 52, so that it goes through opening 44, flexible cushion member 46 with concave forward face 48, insures that nail clippings 52, rearwardly propelled between arms 10, 12, hit face 48 and then drop through opening 44.

In this manner, a simple, yet efficient cutting operation is provided with the disposal of clipped nails into receptacle 42.

In order to empty receptacle 42, the receptacle is removed by sliding it rearwardly in direction 56, so that it can be taken off and emptied from the rear of arms 10, 12.

The foregoing provides a description of a simple, reliable, efficient and easy-to-use nail clipper, which performs its functions of nail cutting, storage and disposal in a very acceptable manner. This invention should not be limited by the preferred embodiment described herein, but its latitude should be governed only by the scope of the following claims:

What is claimed is:

1. A nail clipper for clipping finger and toe nails, having a pair of opposed, pivotably connected upper and lower jaw arms, each including a midportion and terminating in a cutting end edge, a band encircling said arms proximate said edges and movable relative to said upper arm, and a handle member including forward and rear ends wedged between said upper arm and said band, said handle member further including a depending fulcrum operating as a fulcrum point against said upper arm when the rear end of said handle member is pressed to cause the lowering of said upper arm edge toward said lower arm edge, the improvement comprising a receptacle, removable by sliding action in a direction away from said cutting end edges, encircling said midportions and depending below said lower arm and said lower arm defining a receptacle entry opening, all adapted and arranged to cause clipped nails to enter said receptacle through said opening approximately concurrently with said clipping.

2. The invention according to claim 1 wherein the nail clipper further comprises a flexible member positioned between said arms at approximately said midportions.

3. The invention according to claim 2 wherein said flexible member includes a v-shaped rear portion, at which portion there is said pivotable connection between said arms, and a front portion facing said edges, said front portion being slightly concave in a manner to deflect clipped nails through said opening and into said receptacle.

* * * * *